US006126697A

United States Patent [19]

Ebberts

[11] Patent Number: 6,126,697

[45] Date of Patent: Oct. 3, 2000

[54] MULTIPLE CARBONATE CLEANING COMPOUND

[76] Inventor: Jeffrey N. Ebberts, 711 Rosewood, Ardmore, Okla. 73401

[21] Appl. No.: 09/461,261

[22] Filed: Dec. 15, 1999

Related U.S. Application Data

[63] Continuation-in-part of application No. 09/283,254, Apr. 1, 1999, abandoned.

[51] Int. Cl.[7] ..... C11D 7/12; C11D 7/26

[52] U.S. Cl. ..... 8/137; 8/149.1; 8/149.2; 510/278; 510/279; 510/280; 510/434; 510/435; 510/478; 510/488; 510/509; 134/42

[58] Field of Search ..... 510/278–280, 510/434, 435, 478, 488, 509; 8/137, 149.1, 149.2; 134/42

[56] References Cited

U.S. PATENT DOCUMENTS 4,219,333 8/1980 Harris .
5,244,468 9/1993 Harris .
5,624,465 4/1997 Harris .
5,718,729 2/1998 Harris ..... 8/137

*Primary Examiner*—Mark Kopec
*Assistant Examiner*—Brian P. Mruk
*Attorney, Agent, or Firm*—James F. Harvey

[57] ABSTRACT

Carpeting, upholstery, drapery and other textile fibers are cleaned by applying to the fibers, from a pressurized container, an aqueous internally carbonated non-surfactant cleaning composition prepared by admixing, by volume, about 125 ml (150 grams) of an alkaline metal bicarbonate or percarbonate salt, about 62.5 ml (57.4 grams) of a carbonate salt and about 187.5 ml (165 grams) of a natural solid acid, in an aqueous medium such that the natural solid acid reacts with the carbonate/bicarbonate salts to produce carbon dioxide and the solids concentration in the solution resulting from the carbonate salts and natural solid acid forming the basis of the cleaning solution. Citric acid, sodium carbonate and sodium bicarbonate are the preferred solid acid and carbonate salts. The composition is prepared from naturally occurring ingredients and the container is pressurized by air or other environmentally safe gaseous materials. It may be used as a heated or ambient temperature cleaner, to the best advantage of each situation.

22 Claims, No Drawings

MULTIPLE CARBONATE CLEANING COMPOUND

CROSS-REFERENCES TO RELATED APPLICATIONS

This patent application is a continuation-in-part of patent application Ser. No. 09/283,254, filed on Apr. 1, 1999, now abandoned.

BACKGROUND OF THE INVENTION

The current invention relates to the field of internally carbonated non-surfactant cleaning composition for cleaning textile fibers at ambient temperature. More specifically, this invention relates to non-surfactant compositions which are internally-carbonated by mixtures of an acid and two or more different compounds, which are carbonates, bicarbonates, or percarbonates, for the improved ability to clean fibers when the solution is at ambient temperature.

There are myriad types of cleaning compositions for cleaning textile fibers such as carpets, upholstery, drapery, and the like. Most of these cleaning compositions are based on soaps or detergents, both of which are generically referred to as "surfactants". By "detergent" is meant a synthetic amphipathic molecule having a large non-polar hydrocarbon end that is oil-soluble and a polar end that is water soluble. Soap is also an amphipathic molecule made up an alkali salt, or mixture of salts, of long-chain fatty acids wherein the acid end is polar or hydrophilic and the fatty acid chain is non-polar or hydrophobic. Detergents are further classified as non-ionic, anionic, or cationic. Anionic or nonionic detergents are the most common.

Surfactants, i.e. soaps and detergents, are formulated to loosen and disperse soil from textile fibers either physically or by chemical reaction. The soil can then be solubilized or suspended in such a manner that it can be removed from the fibers being cleaned. These surfactants function because the hydrophobic ends of the molecules coat or adhere to the surface of soils and oils and the water soluble hydrophilic (polar) ends are soluble in water and help to solubilize or disperse the soils and oils in an aqueous environment.

There are several problems associated with the use of surfactants for cleaning fibers such as those in carpeting and upholstery. First, large amounts of water are generally required to remove the surfactants and suspended or dissolved particles. This leads to long drying times and susceptibility to mildew. Second, surfactants generally leave an oily hydrophobic coating of the fiber surface. The inherent oily nature of the hydrophobic end of the surfactants causes premature resoiling even when the surfaces have a surfactant coating which is only a molecule thick. Third, surfactants can sometimes cause irritation or allergic reactions in people who are sensitive to these chemicals. Fourth, several environmental problems are associated with the use of soaps and detergents. Some are non-biodegradable and some contain excessive amounts of phosphates which are also environmentally undesirable. However, up until now, the inherent benefits of surfactants have out-weighed the disadvantages of resoiling, skin, membrane or eye irritation, allergic reactions and environmental pollution.

This concern for health and the environment has lead to a search for less toxic, more natural cleaning components. This search for carpet cleaning compositions that also have a balance of cleanability and resoiling resistance has resulted in compositions containing unnatural components that have a greater potential to cause allergenic reaction and other health and environmental problems. Normal soaps prepared from the base hydrolysis of naturally occurring fats and oils are not suitable for carpet cleaning because of the ability of their residues to attract soils. In order to make these residues less soil attracting, detergents are synthetically modified.

Several general problems occur in the use of any cleaning composition. One such general problem is that of oxidative yellowing, or "brown out" as it is commonly called. The usual conditions that increase the potential for brown out are a higher pH cleaner and/or prolonged drying times. Ordinarily the higher the concentration of solids in the cleaning composition, the greater the potential for this oxidative yellowing to produce a noticeable discoloration on carpets.

Another such general problem results from the use of a heated cleaning composition. Heat adversely affects a number of fabrics in residential or commercial use, that is, a heated cleaning solution may cause non-colorfast materials to fade, natural fibers to shrink, or glued fabrics to become unbonded to their substrate. Such materials would include cotton, wool, silk, linen, some rayons, and any of the many combinations thereof. Many organic or natural materials of the type used in the manufacture of oriental or middle eastern rugs and other hand crafted articles from other parts of the world contain dyes that do not have sufficient "set" to allow them to stand up under high temperature cleaners. Also, heated cleaning solutions require a significant amount of energy to heat the solution, as well as specialized equipment. Many residences do not have adequate electrical circuits to carry the amperage required by such equipment. Furthermore, the equipment itself tends to be bulky and difficult to use in a close residential environment, especially when the vendor must provide his own power arrangements; such arrangements generally use long hoses, gasoline generators, and the like. While an elevated temperature may assist in the cleaning of grease or oil stains in which the heat assists in dissolving the stain so that it can be picked up by the cleaning composition, most often the heat does more damage than not.

Carbonation of a cleaning composition has been proposed as a benign way to improve the mechanics of cleaning. A number of prior patents address themselves to this solution through the use of various combinations of carbonate and acid mixtures applied either under pressure or heat. U.S. Pat. No. 4,219,333 by Harris (the '333 patent), issued Aug. 26, 1980, teaches that detergent solutions, when carbonated, rapidly penetrate the textile fibers and, by benefit of the carbonation or effervescing action of the carbon dioxide, draw the suspended soil and oil particles to the surface of the fiber from which they can be removed. Carbonation is achieved by directly injecting carbon dioxide into the cleaning solution in a pressurized container such as a sprayer; internal carbonation is mentioned but not addressed to any extent.

U.S. Pat. No. 5,244,468 by Harris (the '468 patent), issued Sep. 14, 1993, teaches the use of self-carbonated, non-detergent, urea-containing compositions formed from the reaction between a single carbonate salt and a naturally occurring acid or acid forming material in the presence of urea or urea-like compounds. Carbon dioxide is provided both by the self-carbonating action and externally applied gas, i.e. carbon dioxide, which provides an effervescing action for lifting the soil and allowing the urea to clean and remove it.

U.S. Pat. No. 5,718,729 to Harris (the '729 patent), issued Feb. 17, 1998, teaches use of a heated carbonated solution containing urea which is applied to a textile fabric while retaining its carbonation. In achieving the self-carbonating action, the '729 Patent teaches the use of an acid forming material; a single carbonate, bicarbonate, or percarbonate alkaline salt; and urea, the resulting solution being applied in the presence of heat. Although a passing comment is made that mixtures of sodium carbonate and sodium bicarbonate are preferred for the alkaline salt, such a combination is not further taught, tested, nor claimed. Practice of the invention involves heating the cleaning composition to a temperature of at least 140 degrees Fahrenheit.

Although each of these prior art cleaning compositions has its advantages, it can be appreciated that none completely addresses all the problems described above. Thus, it can be seen that there is a need for a carbonated cleaning solution for both carpets and upholstery which has the following characteristics:

1. Improved cleaning properties over the carbonated solutions of the prior art.
2. Ability to perform acceptably at ambient temperatures so as not to damage sensitive fabrics.
3. Ability to perform acceptably at elevated temperatures for oil or grease stains requiring heat to assist in dissolving the stain.
4. Composed of commercially inexpensive compounds.
5. Non-toxic.
6. Environmentally safe.

DISCLOSURE OF THE INVENTION

It is therefore an object of the present invention to provide a cleaning composition that contains as few components as possible and only those materials found in nature.

It is a further object of the present invention to provide a non-surfactant, non-ammonic cleaning composition which rapidly penetrates textile fibers so that the soils and oils may be removed with a lifting action.

It is a further object of the present invention to provide a carbonated cleaning composition which rapidly penetrates textile fibers, suspending soils and oils for removal without leaving a residue on the fibers.

It is a further object of the present invention to produce a cleaning composition that has a self-neutralizing pH balance.

It is a further object of the present invention to provide a process for the cleaning of textile fibers with a carbonated solution wherein soils and oils are effectively removed from the fibers, without the use of surfactants or ammonic derivatives, and suspended in an aqueous environment for a sufficient time to allow the suspended materials and aqueous environment to be extracted or removed from the fibers.

It is a further object of the present invention to provide a cleaning composition which can be used at ambient temperature so that delicate fabrics and/or fibers are not adversely affected.

It is a further object of the present invention to provide a cleaning composition which can also be used at an elevated temperature when necessary without significantly eroding the ability of the cleaning composition to clean fabrics and/or fibers.

It is a further object of the present invention to provide a cleaning composition which is internally carbonated by chemical reaction, and of sufficient cleaning ability as to need no additional ingredients other than those salts and acids involved in the carbonating process.

It is a further object of the present invention to provide a cleaning composition that resists resoiling and yellowing after cleaning.

SUMMARY OF THE INVENTION

These and other objectives are accomplished by means of a cleaning solution which is prepared by combining at ambient temperature an effective amount of an acid or acid forming material which is natural and non-polluting to the environment (such as citric acid, succinic acid, tartaric acid, adipic acid, oxalic acid, glutaric acid, etc.), with a mixture of two or more carbonate, bicarbonate, or percarbonate salts, so that the combination produces carbon dioxide when reacted with the acid as well as producing an effective cleaning composition in and of itself. The use of this composition of ingredients, in solution and without additional surfactants, detergents, ammonic derivatives, or other cleaning agents, gives a unique cleaning composition which, when used at ambient temperature, provides an unexpectedly better cleaning ability than heretofore.

While it has been known that a mixture an acid with a carbonate, a bicarbonate, or a percarbonate in an aqueous solution is useful in the generation of carbon dioxide as an aid in the cleaning of textiles, a mixture of an acid and two or more carbonates, bicarbonates, and percarbonates, used at ambient temperature has never been considered or tested as a textile cleaning compound in and of itself. Such a combination at ambient temperature exhibits an unexpected improvement in the cleaning ability of the combination over similar prior combinations.

More particularly, when mixed together in an aqueous solution at ambient temperature, the preferred mixture of citric acid, sodium carbonate, and sodium bicarbonate produces a wide range of polar and non-polar ended molecules which are able to join with and to bind both ionic and nonionic environmental contaminates which solubilize and are then suspended in the solution until they can be mechanically removed from the textile. This composition has also been shown not to leave soil-attracting residue on the fibers and therefore does not attract or retain soils or oils which come into contact with the fibers following cleaning. Other percarbonates and bicarbonates can be used in place of sodium bicarbonate, and other carbonates can be used in place of sodium carbonate. However, these choices were made based upon their low expense and wide availability.

These and other objects of the invention may be more clearly seen from the detailed description of the preferred embodiment which follows.

DETAILED DESCRIPTION OF THE PREFERRED EMBODIMENT

The ability of a solution of a mixture of an acid or acid forming materials (preferably selected from the group consisting of citric acid, succinic acid, tartaric acid, adipic acid, oxalic acid, glutaric acid, etc.), and a combination of two or more salts (preferably selected from the group consisting of sodium carbonate, sodium bicarbonate, sodium percarbonate, lithium carbonate, lithium bicarbonate, lithium percarbonate, potassium carbonate, potassium bicarbonate, potassium percarbonate, ammonium carbonate, ammonium bicarbonate, ammonium percarbonate, etc.) that produce an abundance of polar and non-polar ended molecules and carbon dioxide when reacted with the acid to surround and suspend soil and or hydrophobic particles such as greases, oils and the like is not believed to have been previously known or used in the cleaning arts. Less effective combinations of acids and carbonates have been used for the production of carbon dioxide and for maintaining a more neutral pH balance of a given solution, as exemplified in U.S. Pat. No. 5,624,465 (the '465 Patent), U.S. Pat. No.

5,244,468 (the '468 Patent), and U.S. Pat. No. 5,718,729 (the '729 Patent), but it is believed that the level of effectiveness of the current invention to clean textiles is surprising and unforeseen.

Both the '465 Patent and the '729 Patent are an improvement of U.S. Pat. No. 4,219,333 (the '333 Patent) and the '468 Patent, but in each case the improvement is most significantly in the area of application, not substance. The '465 Patent speaks to the co-application of a detergent based carbonating solution as covered in the '333 Patent. The '729 Patent speaks to the co-application of a urea based carbonating solution as covered in the '468 Patent. Both patents clearly show a containing need for sulfates, surfactants or ammonias for cleaning ability, however improved the effervescent or lifting effect of the carbon dioxide bubbles might be due to the co-application of acidic and carbonate solutions. The very nature of, or improvement in, the '465 Patent and the '729 Patent speaks directly to the effect of the production of carbon dioxide bubbles in a given cleaning solution and not to an improvement of the solution itself. It is believed that the use of such simple and unique combinations of acids and multiple carbonates, bicarbonates, or percarbonates as contained in the present invention to form a complete cleaning agent per se, is novel and unexpected.

While it is not known with certainty, it is believed that adding a bicarbonate salt to an acid/carbonate solution both fills the function of a surfactant as the needed volatile salt which is the basis of any effective textile cleaner, and also replaces any ammonic additives such as urea, which might act as a cleaning or anti-yellowing agent. It is also supposed that the initial chemical reaction of this solution, $NaHCO_3+NaCO_3+C_6H_8O_7+H_2O=CO_2+H_2O+\{Na^+/HCO3^-Na^+/CO_3^-{}_2C6H_7O_7^-/H^+\}$, releases reagents with a wide range of polar and non-polar ended molecules which then react to and bond with the varying contaminates imbedded in the textile. The addition of positively charged hydrogen molecules released into solution by this reaction, as supplied by the bicarbonate, has a noticeable effect on urine based stains.

Other additives commonly found in commercial cleaning compositions may be added without departing from the scope of this invention provided they do not interfere with the interaction of the acids and carbonates and the creation of carbon dioxide. These include, but are not limited to, bleaches, optical brighteners, fillers, fragrances, antiseptics, germicides, dyes, stain blockers and similar materials.

The carbonation of the solutions results in a rapid lifting action due to the presence of a multitude of effervescent carbon dioxide bubbles. The soils or oil on the fibers being cleaned are surrounded by the complex of carbon dioxide bubbles and polar and non-polar ended molecules which bind with and suspend the soil which then can be lifted from the fibers into the surrounding carbonated aqueous environment. By "aqueous" is meant the presence of water but that does not suggest that copious amounts of water need to be present. A slight dampening of the fiber may be sufficient to promote the lifting action of the effervescent carbonated solution and loosen or dislodge the soil or oil particle from the fiber. The active salts, created by the carbonate/bicarbonate mix, and carbon dioxide interactive substance or complex, holds the soil particles in suspension for a time sufficient for them to be removed from the fiber by means of vacuuming or adsorption onto a textile pad, toweling or similar adsorbent material. An important advantage of this invention is that only minimal amounts of solution are required to effect a thorough cleaning of textile fibers without leaving any residue. Normally, excess amounts of water are used to remove unwanted detergent residues.

The cleaning solution may be prepared in any desired order, e.g. by adding a bicarbonate and a carbonate salt directly to a solution containing the acid and a proper amount of water, adding a carbonate salt and bicarbonate salt to a solution followed by the introduction of the acid, or a concentrate of ingredients consisting of bicarbonate salt, a solid acid and carbonate salt may first be prepared and then diluted with the desired amount of water. The container in which the ingredients are mixed is preferably closed as soon as possible after the acid and carbonate salts start to react to take advantage of maximum carbonation in the solution. However, after mixing, the solution is pressurized by suitable means such as with a compressor, a hand pump, a pump sprayer, and the like using air, nitrogen or any other suitable gas as the pressurizing media and sprayed directly onto the fibers that are being cleaned.

The solution is prepared at ambient temperatures. However, that does not preclude the use of either lower or higher temperatures if such might be desired for any particular application. Obviously, at higher temperatures the reaction between the acid and carbonate/bicarbonate salts will proceed to completion more rapidly; however, the carbonation of the solution may not be as complete because carbon dioxide is much more soluble at lower temperatures. Whatever degree of carbonation is attained will remain in the solution as external air or other gaseous pressure is applied from either a pump or compressor in order to maintain pressure to retain the carbonation until the composition is applied to the fibers. A positive gauge pressure of between about 0.5 to 15.0 atmospheres may be applied. The pressure is not critical as long as it is sufficient to expel the carbonated cleaning solution from a pressurized container onto the surface being cleaned. If it is desired to apply the solution to fabrics at higher temperatures to enhance the activity of any ingredients, such as bleaches, optical brighteners, stain blockers and the like, this may be done without departing from the scope of the invention.

The solution is preferably applied to the textiles, particularly, carpeting or upholstery, as a spray at ambient temperature. When so applied, as through a wand from a pressurized container, the pressure is released and the carbonated cleaning solution breaks into myriad tiny effervescent bubbles which rapidly penetrate into the textile fibers. The effervescent action lifts the soil or oil particles to the surface of the fibers where they can be readily removed by vacuuming or absorption onto a different, but more adsorbent textile, such as a rotating pad or piece of toweling. Because the carbon dioxide bubbles promote rapid drying, and there are no other components other than natural acids and carbonate salts, little or no solution is left on the fibers being cleaned. This contributes to the anti-resoiling properties of the invention. In addition to being a key ingredient to enhance cleaning, it is believed that the bicarbonate, in releasing an additional $H^+$ ion into the solution, also plays an important role in the resulting soft texture of the textile.

As stated above, the ingredients can be admixed and dissolved to make a solution in any desired order. It is the resulting carbonated solution to which the present invention is drawn. The following description is based on the mixing of all solid ingredients prior to their being dissolved to form a solution. The solid acids, carbonate salts and bicarbonate salts are mixed or ground together to form a solid mixture. The solid mixture contains from about 20 to 60% bicarbonate salts, about 20 to 60% of a natural solid acid, and from about 5 to 40% of carbonate salts by volume. However, the amount of the bicarbonate and carbonate salt mixture can be empirically adjusted according to the combination of solid acid and carbonate/bicarbonate salts found to reach an optimal amount. From the results obtained thus far, the most preferable volume ratio of acid: bicarbonate salt: carbonate salt is about 1.0:66.6:33.3, or 50% acid, 33.3% bicarbonate salt and 16.6% carbonate salt. Obviously this ratio is not exact and any variation within about 5% either way is considered within the optimal range, i.e. 35 to 55% solid acid, 27 to 38% bicarbonate salt and 11 to 22% carbonate salt. The solid mixture is dissolved in water which optionally may contain other ingredients such as bleaches, optical brighteners, fillers, fragrances, antiseptics, germicides, dyes, stain blockers and similar materials. The concentration of the acid and carbonate salts in the solution are from about 0.5 to 10% and preferably between about 1 to 5% by weight. These few ingredients produce a solution that is internally carbonated with good cleaning effectiveness.

Since invention was directed towards the improvement of the carbonated or self-carbonated textile cleaning solution, a long list of soap, detergent or other additive based cleaners was not tested. What was used as a basis for testing, or as control, was considered to be the best self-carbonated cleaner in the art of textile cleaning.

The examples which follow are presented to illustrate the invention and for comparative purposes but are not to be considered as limiting as to the scope thereof.

EXAMPLE 1

A commercial carpet cleaning compound, said to contain a mixture of citric acid, sodium carbonate and urea, as described in the '468 Patent and the '729 Patent, was used as a control for a comparative analysis. Although the exact formula of this compound is proprietary, this internally carbonated cleaning composition has been used by an international franchise to clean millions of square feet of carpet and is considered by those knowledgeable in the arts to be the best carbonating cleaner in the industry. This solid mixture, as prepared for commercial use, was added to 4 gallons of water. The solution was then pressurized with air using a compressor and sprayed onto soiled carpet to compare cleanability, resoiling resistance, urine stain removal, and yellowing. Cleaning was completed using a rotary pad.

EXAMPLE 2

A mixture of 200 grams of citric acid and 200 grams of sodium carbonate, also used in previous testing found in the '468 Patent was prepared. This solid mixture was added to 4 gallons of water and pressurized and applied to the carpet samples as described in Example #1.

EXAMPLE 3

A mixture of 200 grams of citric acid and 200 grams of sodium bicarbonate was prepared. This solid mixture was added to 4 gallons of water and pressurized and applied to the carpet samples as described in Example #1.

EXAMPLE 4

A mixture of 187.5 ml (165 grams) of citric acid and 125 ml (150 grams) of sodium bicarbonate and 62.5 ml (57.4 grams) of sodium carbonate was prepared. This solid mixture was added to 4 gallons of water and pressurized and applied to the carpet samples as described in Example #1.

EXAMPLE 5

A mixture of 187.5 ml (165 grams) of citric acid and 62.5 ml (75 grams) of sodium bicarbonate and 125 ml (115 grams) of sodium carbonate was prepared. This solid mixture was added to 4 gallons of water and pressurized and applied to the carpet samples as described in Example #1.

The solutions at ambient temperature and listed in the Examples #2 thru #5 were compared with the commercial composition in Example #1 with regard to cleanability, resoiling resistance, urine stain removal, and yellowing.

Several different carpet samples were chosen to be cleaned, each carpet sample having years of actual soiling and abuse. Cleanability was judged by spraying each sample with the same amount of solution and cleaning in a manner consistent with a professional application of the trade. For initial test purposes that was accomplished by using an absorbent textile towel under hand pressure, spot cleaning different areas of the carpet. A clean towel was used for each solution. The results of this cleaning action were then noted. This was followed by cleaning the entire carpet sample with additional solution and a rotary pad. The cleaning results were again noted. Resoiling was tested by subjecting each sample to equivalent traffic. Urine stain removal was judged using ultraviolet light and visual inspection. Yellowing was judged by cleaning samples of white or light colored textiles for the comparison. The commercial product in Example #1 was given the neutral rating of 5 in each of these four categories. If a solution did not perform as well as the commercial product it was given a lesser value of 0, 1, 2, 3, or 4, 0 being worst, depending on how poor the performance was. If a solution performed better than the commercial product it was given a rating of 6, 7, 8, 9 or 10, ten being best, depending on how much better the solution performed. In other words, below a 5 rating would be substandard and a rating of 6 or higher would indicate a better performance in that particular category. A rating of 5 would indicate no noticeable difference.

As can be readily seen from Table 1, the compositions falling within the scope of the present invention performed better than single carbonate, surfactant and ammonic based cleaning solutions. Also noted was that Example #2, a citric acid and sodium carbonate solution was least effective of those solutions tested. Further comparative tests of the cleanability of the solutions listed above were conducted.

TABLE 1

TESTING OF CARBONATED CLEANING SOLUTIONS AT AMBIENT TEMPERATURE

| | cleanability | resoiling | urine stain removal | yellowing |
|---|---|---|---|---|
| Example 1 | 5 | 5 | 5 | 5 |
| Example 2 | 3 | 2 | 3 | 2 |
| Example 3 | 6 | 5 | 4 | 4 |
| Example 4 | 8 | 9 | 8 | 6 |
| Example 5 | 7 | 6 | 7 | 5 |

The solution described in the '729 Patent (tested in Example #1) is designed specifically to take advantage of the use of heat while still maintaining a high degree of carbonation. The mechanical embodiment for this process is found in U.S. Pat. No. 5,593,091 (the '091 Patent), a dual solution application system. This system allows the carbonating cleaners to be applied to a textile at ambient pressure and at least 140 degrees Fahrenheit. The apparatus described in the '091 Patent was used to test all previously listed examples in the same manner of the first test, the heating being accomplished in accordance with the '729 and '091 Patents. Again, the comparisons were made and judged on the same graduating scale. The neutral score of 5 given to the results of Example #1.

From the results shown in Table 2, it was shown that, when heated, the solution in Example #4 was as good as, or better than, the solution in Example #1, although as a heated solution, the differences between them were not as great as when they were applied at ambient temperature. It was also noted that neither heated Example #1 nor heated Example #4 performed as well on urine stains as the unheated Example #4. The same proved to be true of blood stains.

Another test was performed in which the solutions of Examples #1 and #4 were additionally compared on actual soiled carpets in poorly maintained apartments in the local area. Again, the tests were made with both hot and cold applications. Several of these carpets were judged to be ruined or beyond the realm of cleanability. The apartments were divided and different solutions were used to clean each area. Each solution was sprayed from a pressurized sprayer at ambient temperature and removed from the textile by means of an absorbent pad. A clean pad was used for each application. Ten comparisons were made. For cleanability the solution of Example #1 was judged to clean better on one carpet. On four carpets there was no measurable difference, and on five carpets the solution of Example #4 was better. No clear difference in yellowing could be determined from this testing. For urine removal, old stains that had been previously

TABLE 2

TESTING OF HEATED CARBONATED CLEANING SOLUTIONS

| | cleanability | resoiling | urine stain removal | yellowing |
|---|---|---|---|---|
| Example 1 | 5 | 5 | 5 | 5 |
| Example 2 | 3 | 2 | 3 | 2 |
| Example 3 | 5 | 5 | 4 | 4 |
| Example 4 | 6 | 5 | 6 | 7 |
| Example 5 | 5 | 5 | 6 | 5 |

cleaned by unknown sources were improved equally well by Examples #1 and #4. However, fresh stains, urine stains that had not been cleaned prior to testing showed a marked difference in performance. Example #1 did well, but Example #4 showed a unique and unexpected effervescing action upon contact with the stain, the stain then being more easily and completely removed than with Example #1.

Additional tests were made using the mechanical method described in the '091 Patent, and heated solutions were applied to five different carpets from the same apartment complex, the carpets being divided in the middle of the most worn areas and a different cleaner used on either half. Of these five carpets, both solutions seemed to generate comparative results as to general cleaning. Urine stains were move profoundly affected by the cleaner in Example #4. The overall result was that the acid/carbonate/bicarbonate solution of Example #4 was a better cleaner. Surprisingly, neither Example #1 nor Example #4 did better as a heated cleaner than Example #4 did at ambient temperatures on specific stains and general cleaning. The exception to that was in the case of oils, fats, and greases most commonly found near a household or commercial kitchen area.

Although this invention has been described and illustrated by reference to certain specific solutions these are exemplary only and the invention is limited only in scope by the following claims and functional equivalents thereof.

The invention claimed is:

1. A self carbonated aqueous non-surfactant, non-solvent, or non-ammonic based cleaning composition for textiles prepared by admixing, by volume, (a) about 187.5 ml (165 grams) of a solid acid selected from the group consisting of citric acid, succinic acid, tartaric acid, adipic acid, glutaric acid, and oxalic acid, (b) about 62.5 ml (57.4 grams) of an alkaline carbonate salt, and (c) about 125 ml (150 grams) of an alkaline metal bicarbonate or percarbonate salt, in an aqueous medium such that the solid acid reacts with the alkaline salt mixture to produce carbon dioxide and the solids concentration in the solution resulting from the solid acid and alkaline salt mixture is between about 1.0% to 5% by volume (1.5% to 4% by weight), wherein the cleaning composition is maintained in a pressurized vessel under a positive gauge pressure of between about 0.5 and 15 atmospheres by means of an externally applied gas.

2. The cleaning composition of claim 1 wherein the alkaline carbonate salt is a member selected from the group consisting of sodium carbonate, lithium carbonate, potassium carbonate, and ammonium carbonate.

3. The cleaning composition of claim 2 wherein the alkaline carbonate salt is sodium carbonate.

4. The cleaning composition of claim 1 wherein the alkaline metal bicarbonate or percarbonate salt is a member selected from the group consisting of sodium bicarbonate, sodium percarbonate, lithium bicarbonate, lithium percarbonate, potassium bicarbonate, potassium percarbonate, ammonium bicarbonate, and ammonium percarbonate.

5. The cleaning composition of claim 4 where in the alkaline metal bicarbonate or percarbonate salt is sodium bicarbonate.

6. The cleaning composition of claim 1 wherein the composition is prepared by admixing, in percent by volume, about 35 to 55% of the solid acid, about 11 to 22% of the alkaline carbonate salt, and about 27 to 38% of the alkaline metal bicarbonate or percarbonate salt in an aqueous medium such that the solids concentration resulting from the solid acid and the alkaline salts in the solution is between about 1.0 to 5.0% by volume (1.5% to 4% by weight).

7. The cleaning composition of claim 1 wherein the solid acid is citric acid.

8. The cleaning composition of claim 1 wherein the aqueous medium is water.

9. The cleaning composition of claim 1 wherein said externally applied gas is air.

10. A method of cleaning textile fibers which comprises applying to said fibers, from a pressurized container maintained at a gauge pressure of from about 0.5 to 15 atmospheres by means of an externally applied gas, an aqueous, internally carbonated, non-surfactant, non-solvent, or non-ammonic based cleaning composition for textiles, said cleaning composition prepared by admixing, by volume, (a) about 187.5 ml (165 grams) of a solid acid selected from the group consisting of citric acid, succinic acid, tartaric acid, adipic acid, glutaric acid, and oxalic acid, (b) about 62.5 ml (57.4 grams) of an alkaline carbonate salt, and (c) about 125 ml (150 grams) of an alkaline metal bicarbonate or percarbonate salt, in an aqueous medium such that the solid acid reacts with the alkaline salt mixture to produce carbon dioxide and the solids concentration in the solution resulting from the alkaline salts and solid acid is between about 0.5 and 10% by weight.

11. The method according to claim 10 wherein the alkaline carbonate salt is a member selected from the group consisting of sodium carbonate, lithium carbonate, potassium carbonate, and ammonium carbonate.

12. The method according to claim 11 wherein the alkaline carbonate salt is sodium carbonate.

13. The method according to claim 10 wherein the alkaline metal bicarbonate or percarbonate salt is a member selected from the group consisting of sodium bicarbonate, sodium percarbonate, lithium bicarbonate, lithium percarbonate, potassium bicarbonate, potassium percarbonate, ammonium bicarbonate, and ammonium percarbonate.

14. The method according to claim 13 wherein the alkaline metal bicarbonate or percarbonate salt is sodium bicarbonate.

15. The method according to claim 10, wherein the composition is prepared by admixing, in percent by volume, about 35 to 55% of the solid acid, about 11 to 22% of the alkaline carbonate salt, and about 27 to 38% of the alkaline metal bicarbonate or percarbonate salt in an aqueous medium such that the solids concentration resulting from the solid acid and the alkaline salts in the solution is between about 1.0 to 5.0% by volume (1.5% to 4% by weight).

16. The method according to claim 10 wherein the solid acid is citric acid.

17. The method according to claim 10 wherein the aqueous medium is water.

18. The method according to claim 15 wherein said cleaning composition is applied to textile fibers in the form of a pressurized spray.

19. The method according to claim 18 wherein said textile fibers are in the form of a carpet.

20. The method according to claim 19 wherein said composition is mechanically worked into said fibers.

21. The method according to claim 20 wherein said cleaning composition along with soil particles is released from said fibers by said cleaning composition and is subsequently removed from said fibers by adsorbent or negative pressure extraction methods.

22. The method according to claim 18 wherein said textile fibers are in the form of upholstery.

* * * * *

US006126697C1

(12) EX PARTE REEXAMINATION CERTIFICATE (4909th)

United States Patent

Ebberts

(10) Number: US 6,126,697 C1

(45) Certificate Issued: Feb. 17, 2004

(54) MULTIPLE CARBONATE CLEANING COMPOUND

(75) Inventor: Jeffrey N. Ebberts, Ardmore, OK (US)

(73) Assignee: Ebberts Enterprises, LLC, Ardmore, OK (US)

Reexamination Request:
No. 90/006,083, Aug. 14, 2001
No. 90/006,350, Aug. 8, 2002

Reexamination Certificate for:

| | |
|---|---|
| Patent No.: | **6,126,697** |
| Issued: | **Oct. 3, 2000** |
| Appl. No.: | **09/461,261** |
| Filed: | **Dec. 15, 1999** |

Related U.S. Application Data

(63) Continuation-in-part of application No. 09/283,254, filed on Apr. 1, 1999, now abandoned.

(51) Int. Cl.[7] ..... C11D 7/12; C11D 7/26

(52) U.S. Cl. ..... 8/137; 8/149.1; 8/149.2; 510/278; 510/279; 510/280; 510/434; 510/435; 510/478; 510/488; 510/509; 134/42

(58) Field of Search ..... 510/278, 279, 510/280, 434, 435, 478, 488, 509; 8/137, 149.1, 149.2; 134/42

(56) References Cited

U.S. PATENT DOCUMENTS

| | | | |
|---|---|---|---|
| 4,219,333 | A | 8/1980 | Harris |
| 5,244,468 | A | 9/1993 | Harris et al. |
| 5,624,465 | A | 4/1997 | Harris |
| 5,718,729 | A | 2/1998 | Harris |

FOREIGN PATENT DOCUMENTS

| | | |
|---|---|---|
| WO | WO 98/46716 | 10/1998 |

*Primary Examiner*—Gregory R. Del Cotto

(57) ABSTRACT

Carpeting, upholstery, drapery and other textile fibers are cleaned by applying to the fibers, from a pressurized container, an aqueous internally carbonated non-surfactant cleaning composition prepared by admixing, by volume, about 125 ml (150 grams) of an alkaline metal bicarbonate or percarbonate salt, about 62.5 ml (57.4 grams) of a carbonate salt and about 187.5 ml (165 grams) of a natural solid acid, in an aqueous medium such that the natural solid acid reacts with the carbonate/bicarbonate salts to produce carbon dioxide and the solids concentration in the solution resulting from the carbonate salts and natural solid acid forming the basis of the cleaning solution. Citric acid, sodium carbonate and sodium bicarbonate are the preferred solid acid and carbonate salts. The composition is prepared from naturally occurring ingredients and the container is pressurized by air or other environmentally safe gaseous materials. It may be used as a heated or ambient temperature cleaner, to the best advantage of each situation.

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 10 are determined to be patentable as amended.

Claims 2–9 and 11–22, dependent on an amended claim, are determined to be patentable.

1. A self-carbonated aqueous non-surfactant, [non-solvent, or] non-ammonic based cleaning composition for textiles prepared by admixing, by volume, (a) about 187.5 ml (165 grams) of a solid acid selected from the group consisting of citric acid, succinic acid, tartaric acid, adipic acid, glutaric acid, and oxalic acid, (b) about 62.5 ml (57.4 grams) of an alkaline carbonate salt, and (c) about 125 ml (150 grams) of an alkaline metal bicarbonate or percarbonate salt, in an aqueous medium such that the solid acid reacts with the alkaline salt mixture to produce carbon dioxide and the solids concentration in the solution resulting from the solid acid and alkaline salt mixture is between about 1.0% to 5% by volume (1.5% to 4% by weight), wherein the cleaning composition is maintained in a pressurized vessel under a positive gauge pressure of between about 0.5 and 15 atmospheres by means of an externally applied gas.

10. A method of cleaning textile fibers which comprises applying to said fibers, from a pressurized container maintained at a gauge pressure of from about 0.5 to 15 atmospheres by means of an externally applied gas, an aqueous internally carbonated, non-surfactant, [non-solvent, or] non-ammonic based cleaning composition for textiles, said cleaning composition prepared by admixing, by volume, (a) about 187.5 ml (165 grams) of a solid acid selected from the group consisting of citric acid, succinic acid, tartaric acid, adipic acid, glutaric acid, and oxalic acid, (b) about 62.5 ml (57.4 grams) of an alkaline carbonate salt, and (c) about 125 ml (150 grams) of an alkaline metal bicarbonate or percarbonate salt, in an aqueous medium such that the solid acid reacts with the alkaline salt mixture to produce carbon dioxide and the solids concentration in the solution resulting from the alkaline salts and solid acid is between about 0.5 and 10% by weight.

* * * * *